US006256455B1

(12) United States Patent
Chih

(10) Patent No.: US 6,256,455 B1
(45) Date of Patent: Jul. 3, 2001

(54) APPARATUS AND METHOD FOR PREVENTING FIRE IN A LIQUID HEATING TANK

(75) Inventor: Lin Cheng Chih, Hsin-Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/489,139

(22) Filed: Jan. 21, 2000

(51) Int. Cl.[7] ..... F24H 1/18

(52) U.S. Cl. ..... 392/441; 352/447; 352/450; 396/573

(58) Field of Search ..... 392/441, 442, 392/445, 447, 449, 450; 396/571, 573, 576

(56) References Cited

U.S. PATENT DOCUMENTS 2,232,998 * 2/1941 Cernohouz et al. ..... 165/259
3,147,366 * 9/1964 Dreyfoos ..... 392/444
3,809,858 * 5/1974 Boggs ..... 392/451
4,349,267 * 9/1982 Ohtani ..... 396/625

* cited by examiner

*Primary Examiner*—Philip H. Leung
*Assistant Examiner*—Thor Campbell
(74) *Attorney, Agent, or Firm*—Tung & Associates

(57) ABSTRACT

An apparatus and a method for preventing fire in a liquid heating tank that utilizes resistive heating elements for raising the temperature of a flammable liquid are described. In the apparatus, a buffer tank is provided which is positioned under a process tank that heats the flammable liquid. The buffer tank is equipped with a thermocouple for detecting the temperature of fluid flown therein and an air actuated solenoid valve for shutting off a drain pipe from the buffer tank. When a higher temperature is sensed by the thermocouple, i.e. caused by the mixing of the higher temperature process liquid and the lower temperature water, the air solenoid valve is shut off to cause a back flow of the processed liquid/water mixture into the process tank and thus keeping the heating elements submerged in the processed liquid/water mixture. Any possible exposure of a hot surface of the resistive heating elements to ignite flammable vapor or liquid is thus prevented and a potential fire is avoided.

20 Claims, 2 Drawing Sheets

| Gas | Formula | Molecular Wt. | Boiling Temp. °C | Gravity, g/ml |
|---|---|---|---|---|
| IPA | $C_3H_8O$ | 60.09 | 88.23 | 0.786 (@ 20°C) |
| Acetone | $C_3H_6O$ | 58.08 | 56.0 | 0.791 (@ 20°C) |
| DMSO | $C_2H_6S0$ | 78.13 | 189.0 | 1.01 (@ 20°C) |
| NMP | $C_5H_9NO$ | 99.13 | 202.0 | 1.027 (@ 20°C) |
| MEA | $C_2H_7NO$ | 61.08 | 171.0 | 1.022 (@ 20°C) |
| Dimethyl Sulfide | $C_2H_6S$ | 62.13 | 37.5 | ——— |
| Dimethyl Disulfide | $C_2H_6S_2$ | 94.19 | 108 | ——— |

APPARATUS AND METHOD FOR PREVENTING FIRE IN A LIQUID HEATING TANK

FIELD OF THE INVENTION

The present invention generally relates to an apparatus and a method for preventing fire in a liquid holding tank that is heated by resistive heating elements and more particularly, relates to an apparatus and a method for preventing fire in a liquid holding tank which is filled with a flammable liquid and is heated by resistive heating elements to a temperature of at least 80° C. wherein a fire would otherwise occur when the tank is ruptured to expose the heating elements.

BACKGROUND OF THE INVENTION

In the fabrication of semiconductor integrated circuit (IC) devices, hundreds of fabrication steps must be performed on a semi-conducting substrate in order to complete the fabrication of the devices. The hundreds of processing steps may include cleaning, deposition, etching, buffer coating and various other necessary steps. In these fabrication steps, a variety of process chemicals, including liquids and gases must be used in different processing machines and be transported from their storage tanks to the machines. A large number of these process liquids are of high viscosity and short shelf life and therefore their transportation between a reservoir and a process machine must be carefully controlled. Deterioration or premature reaction of these process liquids can result in poor quality products and unnecessary machine down time which in turn lead to a decrease in process yield.

One of the process liquids that requires delicate handling is a photoresist stripper liquid. A photoresist stripper liquid, in order to be effective in stripping a photoresist layer from an IC device, must be heated to higher than room temperature, i.e. to as high as 80° C. or preferably to as high as 115° C. A typical photoresist liquid is highly flammable and therefore must be carefully controlled during the heating process. For instance, a widely used commercial photoresist stripper of ACT®-690 which contains various low boiling point and high boiling point components is shown in FIG. 1. The low boiling point components, i.e. those having a boiling temperature of up to 100° C., includes dimethyl sulfide, IPA and acetone. The high boiling point components include dimethyl sulfoxide, N-methyl pyrolidone and methyl ethyl alcohol.

A conventional process tank for holding and heating a photoresist liquid is shown in FIG. 2. The process tank 10 is constructed by an inner tank 20, an outer tank 30 and an overflow tank 22 for the inner tank 20. The overflow tank 22 may be advantageously formed integral with the inner tank 20 to prevent overfill of the inner tank 20. The inner tank 20 is filled with a photoresist stripper liquid 24 which is heated by resistive heating elements 26 positioned at near the bottom 28 of the inner tank 20. The resistive heating elements 26 are normally constructed of a metallic heating element embedded in an insulating ceramic coating (not shown). During a regular heating mode, the surface of the resistive heating elements reaches a temperature between about 800° C. and about 1000° C. When the resistive heating elements 26 are properly controlled by a process controller (not shown), the photoresist stripper liquid 24 can be suitably heated to a temperature of about 125° C., or to a temperature of at least 80° C. For more efficient photoresist removal, the higher temperature of 115° C. is more preferred. The inner tank 20 is further equipped with a fluid level indicator 32 which senses the level of the photoresist liquid being stored in the inner tank 20. The overflow tank 22 is further equipped with a set of level sensors 34 for sensing a high level, a normal level and a low level of the photoresist liquid in the overflow tank 22.

Surrounding the inner tank 20 and the overflow tank 22 for holding the photoresist stripper liquid, is an outer tank 30 which is equipped with a water inlet 36 such that the tank is filled with water 38 to a level that at least covers the bottom 28 of the inner tank 20. The use of deionized water is more preferred. The level of water 38 being held in the outer tank 30 is controlled by a fluid level indicator 40 to ensure that the bottom 28 of the inner tank 20 is always immersed in the water 38. The upper level of water 38 is controlled by a drain pipe 42 which drains away overfilled water 38 in the outer tank 30. The outer tank 30 is further equipped with a manual drain valve 44 which is used to completely drain the outer tank 30 when maintenance or cleaning of the tank is required. The inner tank 20 is supported by a plurality of supports 46 positioned on the bottom panel 48 of the outer tank 30. The outer tank is further equipped with an ultrasonic vibration device (not shown) such that ultrasonic vibration can be transmitted to the inner tank 20, i.e. thus to the photoresist stripper liquid 24, to facilitate mixing and to achieve a more uniform temperature in the stripper liquid. The ultrasonic vibration from the outer tank 30 is transmitted to the inner tank 20 by water 38 that contacts at least the bottom 28 of the inner tank 20.

The sidewalls 18 and the bottom wall 28 of inner tank 20 should be constructed in a high temperature resistant material for holding the heated, highly flammable photoresist liquid 24. A suitable material that is chemically inert, dimensionally stable for holding such photoresist stripper liquid heated to a temperature of 115° C. is quartz. The use of a ceramic material such as quartz for forming the inner tank 20 presents a serious problem of breakage due to the fragile nature of quartz upon impact or vibration. When the quartz inner tank 20 breaks or fractures, the photoresist stripper liquid 24 leaks out of the inner tank 20 into the outer tank 30 and mixes with water 38 to be drained out through drain pipe 42 to a fluid level 16 that is below the resistive heating elements 26 and thus leaving the heating elements 26 exposed. When the resistive heating elements 26 are no longer submerged in liquid 24, the high surface temperature of the heating elements, i.e. as high as 1000° C., immediately causes a fire potential by igniting residual photoresist stripper liquid on the heating elements 26, or by igniting the residual vapor left in the inner tank 20 even after the photoresist liquid 24 is substantially drained away. Any such fire would cause a disastrous effect since a number of photoresist stripper tanks may be positioned close to each other, and furthermore, the inner tank 20 normally has a capacity of about 50 liters of the highly flammable liquid. The potential for a severe fire that is difficult to control is therefore very high upon a breakage of the inner tank and must be protected.

It is therefore an object of the present invention to provide an apparatus for preventing fire in a liquid heating tank that does not have the drawbacks or shortcomings of the conventional apparatus.

It is another object of the present invention to provide an apparatus for preventing fire in a liquid heating tank which holds a highly flammable photoresist stripper liquid.

It is a further object of the present invention to provide an apparatus for preventing fire in a liquid heating tank that utilizes resistive heating elements which would be exposed upon a breakage of the tank and cause a fire.

It is another further object of the present invention to provide an apparatus for preventing fire in a liquid heating tank that utilizes resistive heating elements by providing a smaller buffer tank positioned below the liquid heating tank which is equipped with an air solenoid valve for shutting off a drain pipe and thus stopping the photoresist stripper liquid/water mixture from draining from an outer tank.

It is still another object of the present invention to provide an apparatus for preventing fire in a liquid heating tank that utilizes resistive heating elements for heating flammable liquid which is capable of keeping resistive heating elements submerged in the flammable liquid and preventing ignition of the flammable liquid.

It is yet another object of the present invention to provide an apparatus for preventing fire in a liquid heating tank that utilizes resistive heating elements by using a buffer tank positioned under the liquid heating tank for sensing a temperature rise in the buffer tank and shutting off a drain valve such that the resistive heating elements remain submerged in the liquid.

It is still another further object of the present invention to provide a method for preventing fire in a tank for heating a flammable liquid by preventing the exposure of bare heating elements to the flammable liquid or vapor.

SUMMARY OF THE INVENTION

In accordance with the present invention, an apparatus and a method for preventing fire in a liquid heating tank that utilizes resistive heating elements are provided.

In a preferred environment, an apparatus for preventing fire in a liquid heating tank that utilizes resistive heating elements is provided which includes an inner tank for holding a quantity of fluid therein, at least one resistive heating element situated inside the heating tank juxtaposed to a bottom of the inner tank, an outer tank that has a cavity into which the inner tank being positioned, the outer tank has a bottom spaced apart from the bottom of the inner tank and a water inlet pipe for continuously feeding water into the outer tank; a buffer tank situated under the outer tank equipped with a fluid inlet pipe, a fluid outlet pipe, and a temperature sensor, the fluid inlet pipe has a top end that opens to the cavity in the outer tank at an elevation substantially similar to the bottom of the inner tank, the fluid outlet pipe is further equipped with a solenoid control valve for shutting off the fluid outlet pipe when a temperature higher than a pre-set value in the buffer tank is detected by the temperature sensor such that fluid overflows from the buffer tank into the outer tank and the inner tank to submerge the at least one resistive heating element; and a drain pipe that has a top end that opens to the cavity in the outer tank at an elevation at least higher than an elevation of the at least one resistive heating element for draining excess fluid in the outer tank flown in from the buffer tank.

In the apparatus for preventing fire in a liquid heating tank that utilizes resistive heating elements, the quantity of fluid is a flammable fluid, or a fluid that forms a flammable vapor. The inner tank may further include an overflow tank formed unitarily with the inner tank for controlling a fluid level in the inner tank. The quantity of fluid is heated by the at least one resistive heating element to a temperature of at least 80° C., and preferably to a temperature of at least 115° C. The quantity of fluid contains at least one chemical selected from the group consisting of N-methyl-pyrolidone, di-methyl-sulfoxide and amino-ethoxy-ethanol. The inner tank may be fabricated of a ceramic material for withstanding a high fluid temperature of at least 80° C. At least one resistive heating element may have a surface temperature of at least 800° C.

In the apparatus for preventing fire in a liquid heating tank that utilizes resistive heating elements, the water flowing into the outer tank through the water inlet pipe at a rate of between 500 cc/min and 1000 cc/min. The fluid outlet pipe in the buffer tank may have a diameter such that a flow rate of water through the fluid outlet pipe is smaller than 1000 cc/min. The pre-set value of the temperature in the buffer tank is not lower than 60° C. The buffer tank may further include a level sensor for sensing a minimum level of fluid in a buffer tank and for shutting off the solenoid controlled so as to cause a fluid level in the tank to rise. The buffer tank may have a capacity smaller than five liters while the outer tank and the inner tank together may have a capacity of larger than 30 liter. The water in the outer tank may be subjected to ultrasonic vibration for transmission to the inner tank.

The present invention is further directed to a method for preventing fire in a tank for heating a flammable liquid that can be carried out by the operating steps of providing an inner tank for holding a flammable liquid therein; mounting at least one resistive heating element in the heating tank juxtaposed to a bottom of the inner tank; positioning the inner tank in an outer tank filled with water such that at least the bottom of inner tank is immersed therein; mounting a buffer tank under the outer tank for fluid communication with the outer tank through a fluid inlet pipe and with a drain valve through a fluid outlet pipe such that the buffer tank is fulled with a fluid consisting essentially of water from the other tank; and sensing a temperature of the fluid in the buffer tank and closing the drain valve when a temperature sensed exceeds a pre-set value such that fluid overflows from the buffer tank into the outer tank and the inner tank through the fluid inlet pipe to submerge the at least one resistive heating element positioned in the inner tank.

The method for preventing fire in a tank for heating a flammable liquid may further include the steps of mounting a level sensor in the buffer tank, sensing a minimal level in the buffer tank, and closing the drain valve such that fluid overflows from the buffer tank into the outer tank and inner tank to submerge the at least one resistive heating element. The method may further include the step of transmitting ultrasonic vibration into the inner tank through the outer tank. The method may further include the step of closing the drain valve when a temperature sensed in the fluid exceeds 60° C. The method may further include the step of heating the flammable liquid in the inner tank to a temperature of at least 80° C.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figures 1, 2:
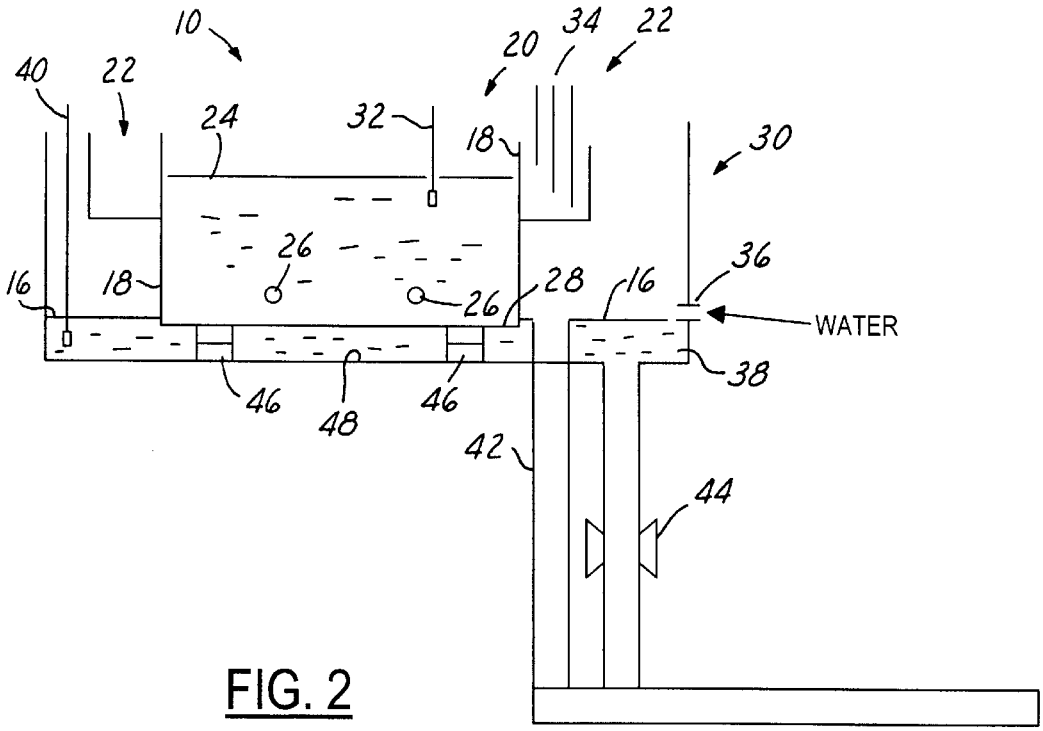
(Prior Art) FIG. 1
FIG. 1 is a chart illustrating typical components in a commercially available photoresist stripper liquid of ACTS®-690.
FIG. 2 is a cross-sectional view of a conventional process tank for holding a heated photoresist stripper liquid in an inner tank that is submerged in water in an outer tank.
Figure 3:
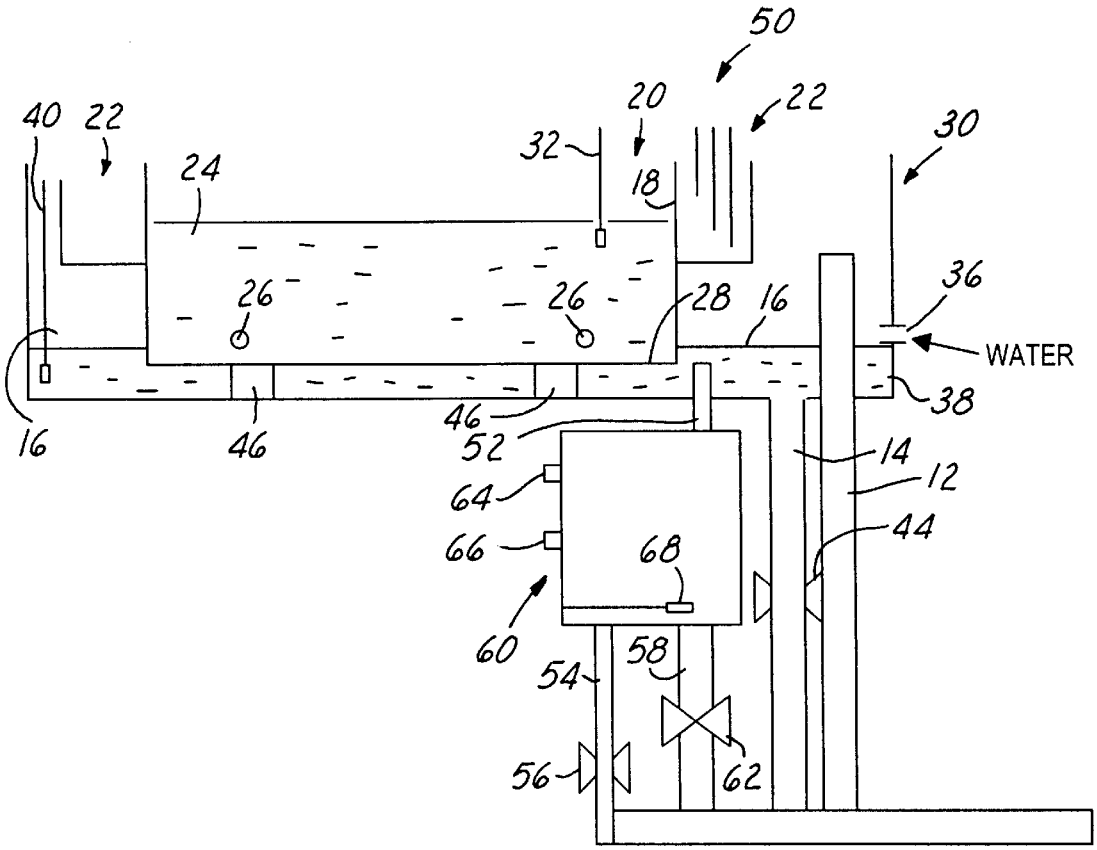
FIG. 3 is a cross-sectional view of the present invention process tank for holding a photoresist stripper liquid that is equipped with a buffer tank to prevent the resistive heating elements from being exposed to either a flammable liquid or flammable vapor of the photoresist stripper.

The present invention discloses an apparatus and a method which can be used to remedy problems caused by the conventional process tank shown in FIG. 2 when there is a breakage of the inner quartz tank. In the conventional process tank shown in FIG. 2, when the quartz tank breaks, there is a sudden drop in the liquid level. At such time, since the surface temperature of the resistive heating elements is still at between 800° C. and 1000° C., any residual stripper liquid or vapor will be ignited by the heating elements. The present invention novel and apparatus and method are designed based on the principle that if the photoresist stripper liquid level can be kept high enough to keep the resistive heating elements submerged, any danger of a fire is eliminated In the present invention apparatus 50, as shown in FIG. 3, an inner tank 20, an overflow tank 22 and an outer tank 30 similar to that shown in the conventional process tank 10 are utilized. Under the outer tank 30, is mounted a buffer tank 60 in fluid communication with the outer tank 30 by a fluid inlet pipe 52. The buffer tank 60 is further provided with a fluid outlet pipe 54 which is equipped with an air solenoid valve (ASV) 56 for controlling a liquid to flow therethrough. The buffer tank 60 is further provided with a drain pipe 58 controlled by a manual valve 62 for maintenance and cleaning purposes. The buffer tank is further equipped with a high fluid level sensor 64 and a normal fluid level sensor 66 for sensing the fluid level in the buffer tank 60. A thermal couple 68 is provided and mounted juxtaposed to a bottom of the buffer tank 60 for sensing a temperature of the liquid that enters the buffer tank 60.

In the present invention process tank 50, the buffer tank 60, is equipped with an air solenoid valve 56 for closing the valve when the fluid level in the buffer tank 60 is below which can be sensed by the normal fluid level sensor 66, or when the temperature read by the thermocouple 68 is higher than a pre-set temperature. Furthermore, the diameters of the fluid inlet pipe 52 and the fluid outlet pipe 54 are chosen such that a flow rate through the pipes cannot exceed 1000 cc/min. Such selection of the pipe diameter keeps the liquid level in the inner tank 20 higher than the resistive heating elements 26 after a breakage has occurred in the inner tank 20. Drain pipe 14 is provided for maintenance and cleaning of the outer tank 30 and is controlled by a manual drain valve 44. A second drain pipe 12 is provided for preventing the fluid level in the outer tank 30 from getting too high, i.e. from overfilling the outer tank 30. It has been found that a normal temperature of an ultrasonic vibrated water 38 is about 40–50° C. A warning signal will alert a machine operator to check various machine status when the buffer tank temperature sensed by the thermocouple 68 is higher than 50° C. The volume of the buffer tank 60 is kept at about 2 liter, which is substantially smaller than that of the outer tank 30 and the inner tank 20 which has a combined volume of about 50 liters.

The operation of the present invention novel process tank 50 can be described as follows: during normal operation, deionized water flows through water inlet 36 in a continuous manner into the outer tank 30 and thus filling the bottom of the outer tank and contacting the bottom wall 28 of the inner tank 20. Any excess water in the outer tank 30 will be drained from the fluid inlet pipe 52 into the buffer tank 60 and away through drain pipe 54 through the air solenoid valve 56.

When a breakage in the inner tank 20 occurs, the photoresist stripper liquid 24 flows into the outer tank and mixes with water 38 that is already in the outer tank. As a result, the temperature of water 38 increases from a normal water temperature of about 30–40° C. to a higher temperature since the photoresist stripper liquid is normally kept at 115° C. The photoresist stripper liquid/water mixture at a higher temperature thus flows into the buffer tank 60 through fluid inlet pipe 52 and is detected by the thermocouple 68. When the temperature detected by the thermocouple 68 is higher than 60° C. the air solenoid valve 56 is closed by a process controller (not shown). Since the photoresist stripper/water mixture continuously flows into the buffer tank 60 through the fluid inlet pipe 52, the buffer tank is filled to the top and thus overflows into the outer tank 30. Since water continuously flows through water inlet 36 and mixes with the photoresist stripper liquid 24 after the inner tank breakage, the level of the fluid mixture in the outer tank will be maintained at the elevation of the drain pipe 12, i.e. at an elevation substantially higher than that of the resistive heating elements 26 and therefore keeping the heating elements submerged in the fluid mixture.

The present invention novel apparatus is further provided with means for preventing any possible malfunction of the air solenoid valve 56. For instance, if a malfunction of the air solenoid valve 56 occurs, i.e. the valve does not close, the small diameter pipe used in the fluid inlet pipe 52 only allows a flow at less than 1000 cc/min to pass therethrough. As a result, it takes a long period of time to completely drain the outer tank due to its large capacity of 50 liters. For instance, at a flow rate smaller than 1000 cc/min, it has been found that at least 50 minutes is required to drain the outer tank completely. Since there is no flammable liquid, i.e. photoresist stripper liquid left in the inner tank 20, there is no potential fire hazard that can be caused by the resistive heating elements 26 even when the elements are no longer submerged in liquid.

When the normal fluid level sensor 66 is turned on, i.e. a fluid level is sensed, the air actuated solenoid valve 56 opens to drain the photoresist stripper liquid/water mixture. Since the stripper liquid is a highly viscous material, the fluid drains slowly and therefore further postponing the exposure of the heating elements 26 to any flammable vapor. When the upper fluid level sensor (64) is turned on, i.e. a fluid level is sensed, which indicates a blocked fluid outlet pipe 54 or a malfunctioned air solenoid valve 56 (i.e., not opened), an alarm will sound to alert the machine operator to check the system.

The present invention novel apparatus presents numerous advantages over a conventional apparatus. For instance, a thermocouple is used to sense a liquid temperature in the buffer tank, an air solenoid valve is used to control the drain pipe from the buffer tank, and furthermore, a small diameter pipe is used at a controlled flow of less than 1000 cc/min when the air solenoid valve malfunctions (i.e., does not close) such that liquid is drained only slowly from the system.

The present invention apparatus and method for preventing fire in a liquid heating tank that utilizes resistive heating elements having therefore being amply described in the above description and in the appended drawings of FIGS. 2 and 3.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for preventing fire in a liquid heating tank that utilized resistive heating elements comprising:

an inner tank for holding a quantity of fluid therein;

at least one resistive heating element situated inside said inner tank juxtaposed to a bottom of said inner tank;

an outer tank having a cavity into which said inner tank being positioned, said outer tank having a bottom spaced apart from said bottom of said inner tank and a water inlet pipe for continuously feeding water into said outer tank;

a buffer tank situated under said outer tank equipped with a fluid inlet pipe, a fluid outlet pipe and a temperature sensor, said fluid inlet pipe having a top end that opens to said cavity in said outer tank at an elevation substantially similar to said bottom of said inner tank, said fluid outlet pipe further equipped with a solenoid controlled valve for shutting off said fluid outlet pipe when a temperature higher than a pre-set value in said buffer tank is detected by said temperature sensor such that fluid overflows from said buffer tank into said outer tank and said inner tank submerging said at least one resistive heating element; and a drain pipe having a top end that opens to said cavity in said outer tank at an elevation at least higher that an elevation of said at least one resistive heating element for draining excess fluid in said outer tank flown in from said buffer tank.

2. An apparatus for preventing fire in a liquid heating tank that utilizes resistive heating elements according to claim 1, wherein said quantity of fluid is a flammable fluid.

3. An apparatus for preventing fire in a liquid heating tank that utilizes resistive heating elements according to claim 1, wherein said quantity of fluid is a fluid that forms a flammable vapor.

4. An apparatus for preventing fire in a liquid heating tank that utilizes resistive heating elements according to claim 1, wherein said inner tank further includes an overflow tank formed unitarily with said inner tank for controlling a fluid level in said inner tank.

5. An apparatus for preventing fire in a liquid heating tank that utilizes resistive heating elements according to claim 1, wherein said quantity of fluid being heated by said at least one resistive heating element to a temperature of at least 80° C.

6. An apparatus for preventing fire in a liquid heating tank that utilizes resistive heating elements according to claim 1, wherein said quantity of fluid being heated by said at least one resistive heating element to a temperature of at least 115° C.

7. An apparatus for preventing fire in a liquid heating tank that utilizes resistive heating elements according to claim 1, wherein said quantity of fluid contains at least one chemical selected from the group consisting of N-methyl-pyrolidone, di-methyl-sulfoxide and amino-ethoxy-ethanol.

8. An apparatus for preventing fire in a liquid heating tank that utilizes resistive heating elements according to claim 1, wherein said inner tank being fabricated of a ceramic material for withstanding a high fluid temperature of at least 80° C.

9. An apparatus for preventing fire in a liquid heating tank that utilizes resistive heating elements according to claim 1, wherein said at least one resistive heating element having a surface temperature of at least 800° C.

10. An apparatus for preventing fire in a liquid heating tank that utilizes resistive heating elements according to claim 1, wherein said water flowing into said outer tank through said water inlet pipe at a flow rate of between 500 cc/min and 1000 cc/min.

11. An apparatus for preventing fire in a liquid heating tank that utilizes resistive heating elements according to claim 1, wherein said fluid outlet pipe in said buffer tank has a diameter such that a flow rate of water through said fluid outlet pipe is smaller than 1000 cc/min.

12. An apparatus for preventing fire in a liquid heating tank that utilizes resistive heating elements according to claim 1, wherein said preset value of said temperature in said buffer tank is not lower than 60° C.

13. An apparatus for preventing fire in a liquid heating tank that utilizes resistive heating elements according to claim 1, wherein said buffer tank further comprises a level sensor for sensing a minimum level of fluid in said buffer tank and for shutting off said solenoid controlled valve so as to cause a fluid level in said tank to rise.

14. An apparatus for preventing fire in a liquid heating tank that utilizes resistive heating elements according to claim 1, wherein said buffer tank has a capacity smaller than 5 liter while said outer tank and said inner tank together has a capacity of larger than 30 liter.

15. An apparatus for preventing fire in a liquid heating tank that utilizes resistive heating elements according to claim 1, wherein said outer tank being subjected to ultrasonic vibration for transmitting to said inner tank.

16. A method for preventing fire in a tank for heating a flammable liquid comprising the steps of:

providing an inner tank for holding a flammable liquid therein;

mounting at least one resistive heating element in said inner tank juxtaposed to a bottom of the inner tank;

positioning said inner tank in an outer tank filled with water such that at least said bottom of the inner tank being immersed therein;

mounting a buffer tank under said outer tank for fluid communication with said outer tank through a fluid inlet pipe and with a drain valve through a fluid outlet pipe such that said buffer tank being filled with a fluid consisting essentially of water from said outer tank; and sensing a temperature of said fluid in said buffer tank and closing said drain valve when a temperature sensed exceeds a preset value such that said fluid overflows from said buffer tank into said outer tank and said inner tank through said fluid inlet pipe to submerge said at least one resistive heating element in said inner tank.

17. A method for preventing fire in a tank for heating a flammable liquid according to claim 16 further comprising the steps of:

mounting a level sensor in said buffer tank;

sensing a minimum level in said buffer tank; and closing said drain valve such that said fluid overflows from said buffer tank into said outer tank and inner tank to submerge said at least one resistive heating element.

18. A method for preventing fire in a tank for heating a flammable liquid according to claim 16 further comprising the steps of transmitting an ultrasonic vibration into said inner tank through said outer tank.

19. A method for preventing fire in a tank for heating a flammable liquid according to claim 16 further comprising the step of closing said drain valve when a temperature sensed in said fluid exceeds 60° C.

20. A method for preventing fire in a tank for heating a flammable liquid according to claim 16 further comprising the step of heating said flammable liquid in said inner tank to a temperature of at least 80° C.

* * * * *